US005544544A

United States Patent [19]

Höppner et al.

[11] Patent Number: 5,544,544

[45] Date of Patent: Aug. 13, 1996

[54] THROTTLE TRIGGER DEVICE FOR AN INTERNAL COMBUSTION ENGINE OF A WORKING TOOL

[75] Inventors: Klaus Höppner, Marbach; Bernd Kaiser, Winnenden, both of Germany

[73] Assignee: Andreas Stihl, Waiblingen, Germany

[21] Appl. No.: 355,852

[22] Filed: Dec. 14, 1994

[30] Foreign Application Priority Data

Dec. 14, 1993 [DE] Germany ..... 9319165 U

[51] Int. Cl.[6] ..... G05G 5/08

[52] U.S. Cl. ..... 74/526; 74/483 R

[58] Field of Search ..... 74/493 R, 526

[56] References Cited

U.S. PATENT DOCUMENTS 2,917,944 12/1959 Hills ..... 74/526
4,254,667 3/1981 Wong ..... 74/526
4,936,271 6/1990 Nagashima et al. ..... 123/195 C

FOREIGN PATENT DOCUMENTS 3916414 12/1989 Germany .
2263197 7/1993 United Kingdom ..... 74/526

*Primary Examiner*—Allan D. Herrmann
*Attorney, Agent, or Firm*—W. Becker & Associates

[57] ABSTRACT

A throttle trigger device for an internal combustion engine of a working tool has a throttle trigger connected to the handle of the working tool so as to be pivotable about a pivot axis. A throttle trigger lock is connected to the handle of the working tool so as to be pivotable about a pivot axis. A spring is connected between the throttle trigger and the throttle trigger lock. The throttle trigger, the throttle trigger lock, and the spring form a unitary part. The spring rests at an abutment of the handle at least when under load such that the spring is divided into functionally independent sections, whereby a first section extends between the abutment and the throttle trigger and a second section extends between the abutment and the throttle trigger lock.

18 Claims, 3 Drawing Sheets

THROTTLE TRIGGER DEVICE FOR AN INTERNAL COMBUSTION ENGINE OF A WORKING TOOL

BACKGROUND OF THE INVENTION

The present invention relates to a throttle trigger device for an internal combustion engine of a working tool, especially of a motor chainsaw, wherein a throttle trigger lock is provided that is connected to the throttle trigger with a spring. The throttle trigger and the throttle trigger lock are pivotably supported and form a unitary part together with the spring. The unitary part is arranged within the handle of the working tool.

Such a throttle trigger device is known from German Patent 39 16 414. The throttle trigger is arranged within the handle of the working tool and forms together with the throttle trigger lock a unitary component. The throttle trigger and the throttle trigger lock are arranged within the handle such that they are postioned atop one another so that an operator with the palm of his hand operates the throttle trigger lock and with one or more fingers of his hand the throttle trigger. The throttle trigger can only be pivoted when the throttle trigger lock is pressed down. The two levers (throttle trigger and throttle trigger lock) are connected with a spring to form a unitary part. The spring maintains the levers in their respective rest position. The operator must exert a pressure counter to the force of the spring in order to activate the throttle trigger. Each movement of one of the levers causes tension on the spring which acts as a reactive force on the other lever. The spring characteristics, i.e., the course of the spring force as a function of the pivot path, is substantially equal for both levers. Thus, the force acting on the throttle trigger in the full load position also acts on the palm of the operator. During longer operating periods this is not only uncomfortable, but can also be painful.

It is furthermore disadvantageous that the throttle trigger lock, the spring and the throttle trigger are arranged in one plane which results in a relatively great constructive height. The handle which receives the levers and the spring therefore must be constructed to be very large which is ergonomically unfavorable.

It is therefore an object of the present invention to provide a throttle trigger device in which the throttle trigger, the spring, and the throttle trigger lock form a unitary component such that constructively simple means, despite the use of a common spring, the throttle trigger is substantially unaffected by actuating forces of the throttle trigger lock.

SUMMARY OF THE INVENTION

The throttle trigger device for an internal combustion engine of a working tool according to the present invention is primarily characterized by:

A throttle trigger connected to a handle of the working tool so as to be pivotable about a pivot axis;

A throttle trigger lock connected to the handle of the working tool so as to be pivotable about a pivot axis;

A spring connected between the throttle trigger and the throttle trigger lock;

The throttle trigger, the throttle trigger lock, and the spring forming a unitary part; and Wherein the spring rests at an abutment of the handle at least when under load such that the spring is divided into functionally independent sections, a first section extending between the abutment and the throttle trigger and a second section extending between the abutment and the throttle trigger lock.

Preferably, the first section and the second section are positioned in two parallel planes that are spaced at a distance from one another.

Advantageously, the spring comprises a connecting section connecting the first section and the second section and bridging the distance between the parallel planes.

Preferably, the throttle trigger is positioned in one parallel plane and the throttle trigger lock is positioned in the other parallel plane.

Expediently, the throttle trigger and the throttle trigger lock are positioned together in one of the parallel planes.

Preferably, the connecting section is connected to ends of the first and second sections that are pointing in the same direction.

In another preferred embodiment of the present invention the first and second sections are in the form of leaf springs. Preferably the first and second sections have a curvature that is preferably of a wave shape, especially a sine wave.

Preferably, the unitary part is mounted within the handle such that the spring is prestressed.

In yet another embodiment of the present invention, the pivot axis of the throttle trigger and the pivot axis of the throttle trigger lock extend parallel to one another.

Advantageously, the throttle trigger lock has a locking projection facing the throttle trigger and the throttle trigger has a locking pin. The locking projection, in the rest position of the throttle trigger lock, is positioned in a pivot path of the locking pin.

Expediently, the locking projection has a receiving slot that, in an actuated position of the throttle trigger lock, is positioned facing the locking pin so that, upon pivoting the throttle trigger, the locking pin is pivoted into the receiving slot.

Preferably, the locking pin rests on an inner side of the locking projection that is facing the receiving slot.

Advantageously, the inner side is curved so as to conform to a pivot path of the locking pin such that the locking pin resting at the inner side locks the throttle trigger lock when the throttle trigger is pivoted.

Preferably, the unitary part is injection-molded from plastic. The plastic is preferably polyacetal.

Dividing the spring into functionally separate sections makes it possible that the throttle trigger and the throttle trigger lock each have separate spring sections coordinated therewith that have different spring characteristics. The reaction forces resulting from the movement of the throttle trigger and the simultaneously occurring spring tension are received at the abutment at which the spring rests and transmitted into the housing of the handle. Thus, the spring sections are substantially decoupled from one another. The different spring characteristics of the individual spring sections are advantageously imparted by constructive means, i.e., in the form of different spring geometries.

Expediently, the spring section of the throttle trigger and the spring section of the throttle trigger lock can be arranged in different planes whereby the two planes are spaced from one another and extend parallel to one another. The connection of the two spring sections in this arrangement is advantageously ensured by having a connecting section connecting the two spring sections. The support of the spring at the handle preferably takes place in the area of the connecting section. The connecting section is positioned with one transition area in the plane of one spring section and with the other transition area in the plane of the other spring section. With the substantially adjacently arranged spring sections a minimum constructive height is achieved resulting in a corresponding reduction of the cross-sectional size of the handle.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 3:
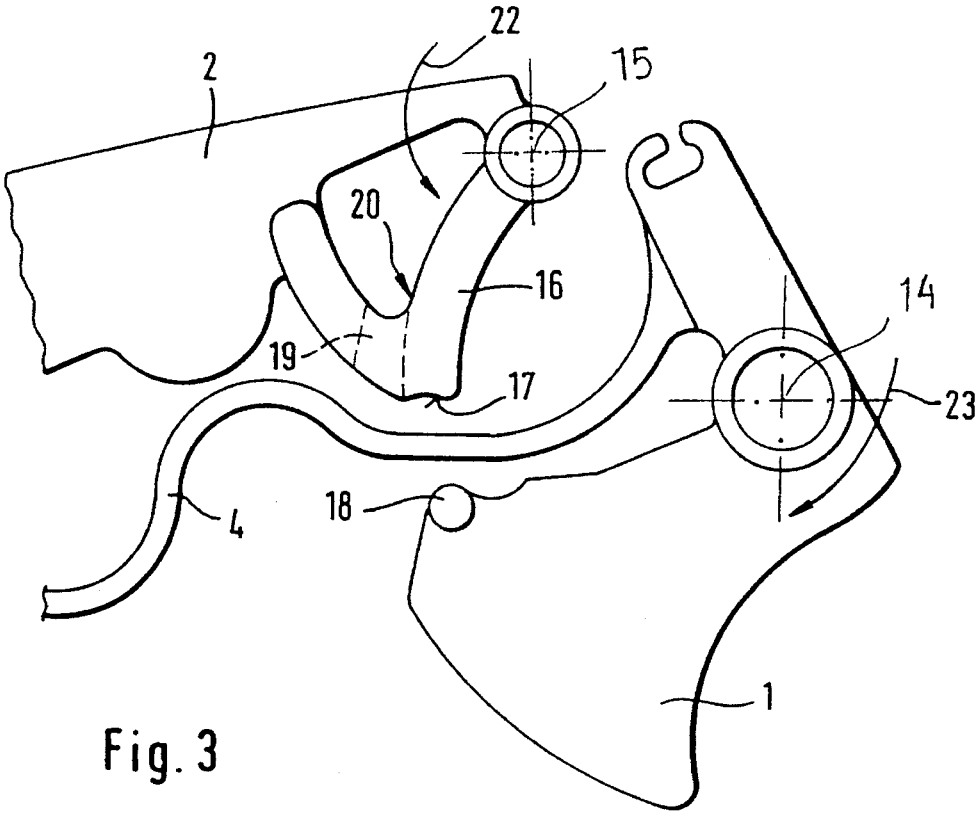
FIG. 3 shows another side view of the unitary components.

The present invention will now be described in detail with the aid of several specific embodiments utilizing FIGS. 1 through 3.

Figure 1:
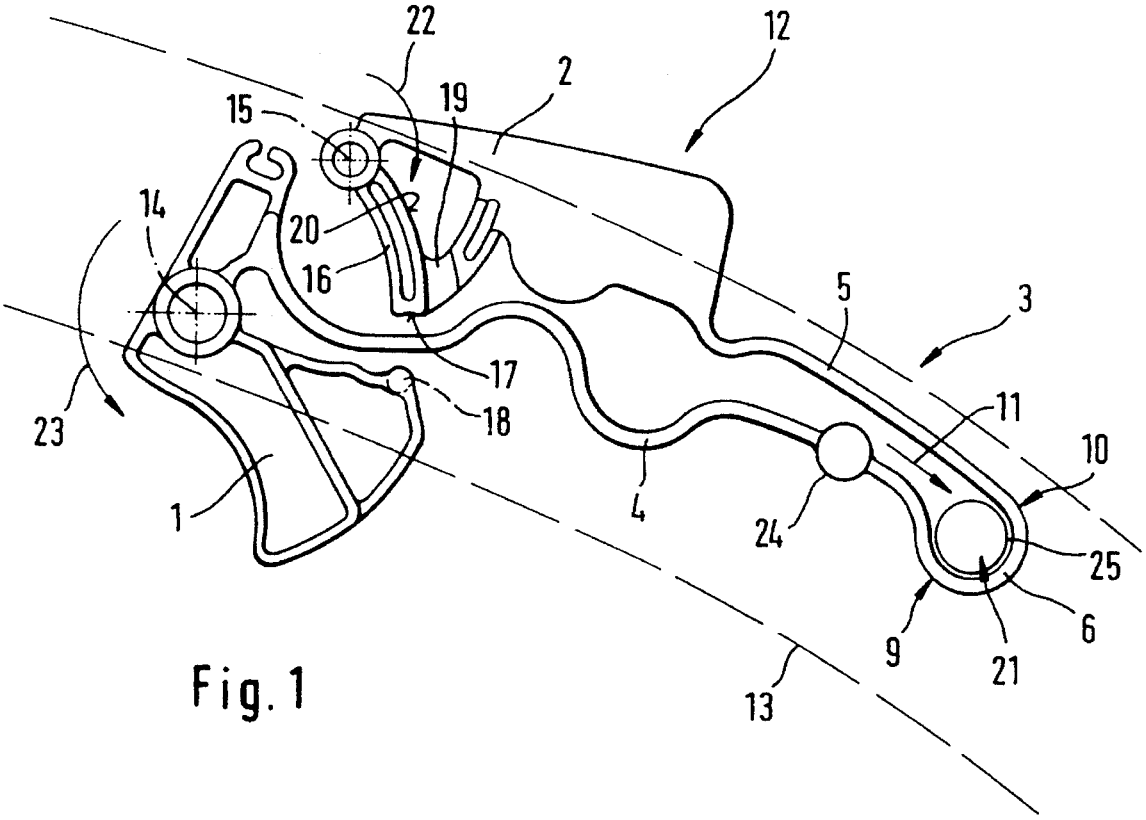
FIG. 1 shows a side view of a unitary part comprised of a throttle trigger, a spring, and a throttle trigger lock.
Figure 2:
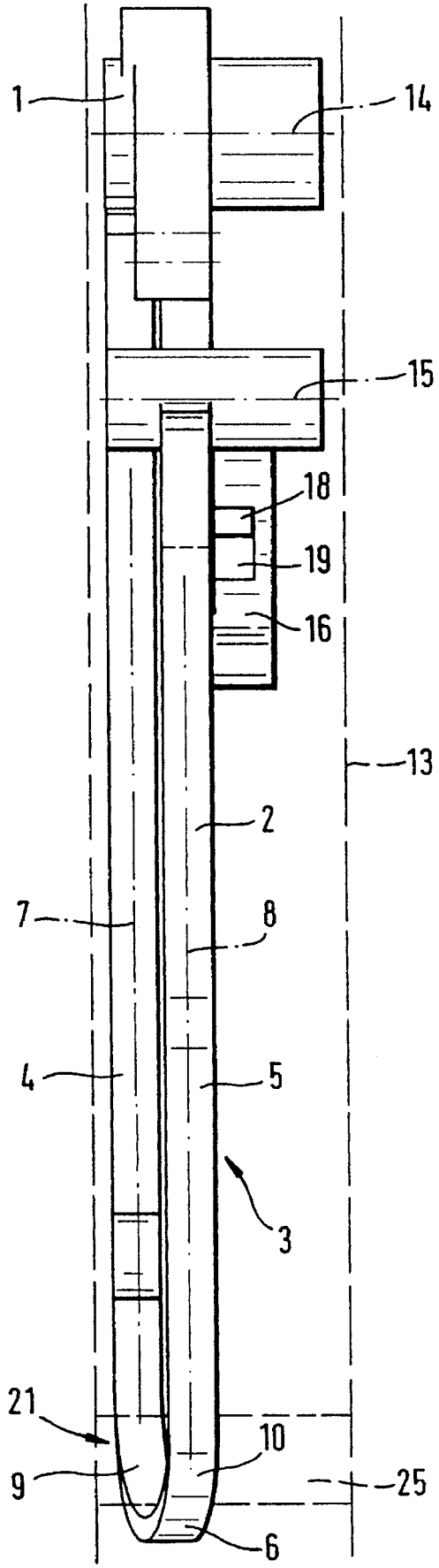
FIG. 2 shows a plan view of the unitary part of FIG. 1.

According to FIG. 1, a throttle trigger 1, a throttle trigger lock 2, and a spring 3 connecting the throttle trigger 1 and the throttle trigger lock form a unitary component 12. The levers (throttle trigger and throttle trigger lock) of the component 12 which are to be actuated manually serve to control the throttle valve of an internal combustion engine. Instead of an internal combustion engine it may also be expedient to use an electric drive motor. For reasons of safety, the throttle trigger 1 can be pivoted only when the throttle trigger lock 2 is pressed down by the hand of the operator. In order to be able to actuate in an ergonomically favorable manner with one hand the throttle trigger lock 2 and the throttle trigger 1, the two levers are arranged substantially one atop the other within the handle 13 of the working tool. The throttle trigger lock 2 projects past the upper side of the handle, while the throttle trigger 1 is arranged at the opposite underside of the handle 13. The hand of the operator encloses the grip such that with his palm a pressure is exerted onto the throttle trigger lock 2 and on the opposite side the throttle trigger 1 can be pivoted in an easily adjustable manner by one or more fingers of the same hand.

Especially when operating the working tool for an extended period of time, the pressure on the palm of the operator's hand resulting from pressing down on the gas throttle lock 2 should not become uncomfortable, but on the other hand greater return forces on the throttle trigger 1 are required for exact throttle adjustability.

According to the invention the spring 3 is thus functionally divided into two sections by providing a connecting section 6 of the spring 3 that at least under load rests on an abutment 21. Such a support can be achieved, for example, by resting the connecting section 6 at a bolt 25 that is fixedly connected to the handle 13. The spring 3 is thus functionally divided into two spring sections 4 and 5. The spring section 4 is coordinated with the throttle trigger 1, and the spring section 5 is coordinated with the throttle trigger lock 2. Preferably, the connecting section 6 is connected to the ends of the spring sections 4 and 5 that extend in the same direction (arrow 11), i.e., to the ends that in the axial direction of the handle 13 are facing away from the throttle trigger 1 and the throttle trigger lock 2.

The spring characteristics of the spring sections 4 and 5 are determined by the geometric design of the spring 3. Each spring section 4, 5 advantageously can be designed as a leaf spring and advantageously should have a curvature. During pivoting of the levers the spring is loaded in the pulling direction and is thus brought into a stretched position, i.e., the curvature is flattened. The reaction forces of the spring sections 4, 5 are received to a large extent by the bolt 25 due to the pulling actions so that the spring action of each spring section 4, 5 are decoupled from one another. In order to be able to pivot the levers, the throttle trigger 1 as well as the throttle trigger lock 2 are supported on the handle 13 so as to be pivotable about pivot axes 14 and 15 that extend parallel to one another. When the operator presses down the throttle trigger 2 with his palm, the throttle trigger lock 2 is pivoted in the direction of arrow 22 about the pivot axis 15. This results in a stretching of the spring section 5 and loading in the pulling direction. In the same manner, after the throttle trigger lock 2 has been pressed down, the throttle trigger 1 is pivoted in the direction of arrow 23 about the pivot axis 14 and stretches the spring section 4. The spring action can advantageously be provided by designing the spring in a wave-shaped manner, especially in the form of a sine wave (compare FIG. 1). The sine wave design of the spring section can be superimposed on a curvature of the leaf spring in order to provide for a progressive spring characteristic within the range of full load of the throttle trigger 1. Accordingly, first the soft sine wave shaped spring is stretched in the range of a small pivot movement and only afterwards the sine wave shaped spring is additionally subjected to a stretching of the leaf spring for greater pivot movements.

In a further advantageous embodiment the spring sections 4 and 5 of the throttle trigger 1 and the throttle trigger lock 2 can be arranged in different planes 7 and 8 which coincide with the plane of movement of the respective spring section 4, 5 and are vertical to the pivot axes 14 and 15. The connecting section 6 between the spring sections 4 and 5 has transition zones 9, 10 into the respective spring sections 4, 5 that are arranged in the respective plane 7, 8 of the spring section 4, 5 (compare FIG. 2). The spring sections 4 and 5 thus can be positioned substantially parallel to one another when the two levers are actuated. It may be expedient to arrange the throttle trigger 1 or the throttle trigger lock 2, respectively, both of them, in one of the two planes.

The component 12 is preferably mounted within the handle 13 under prestress so that the levers are forced into their rest position when not activated.

Figure 3A:
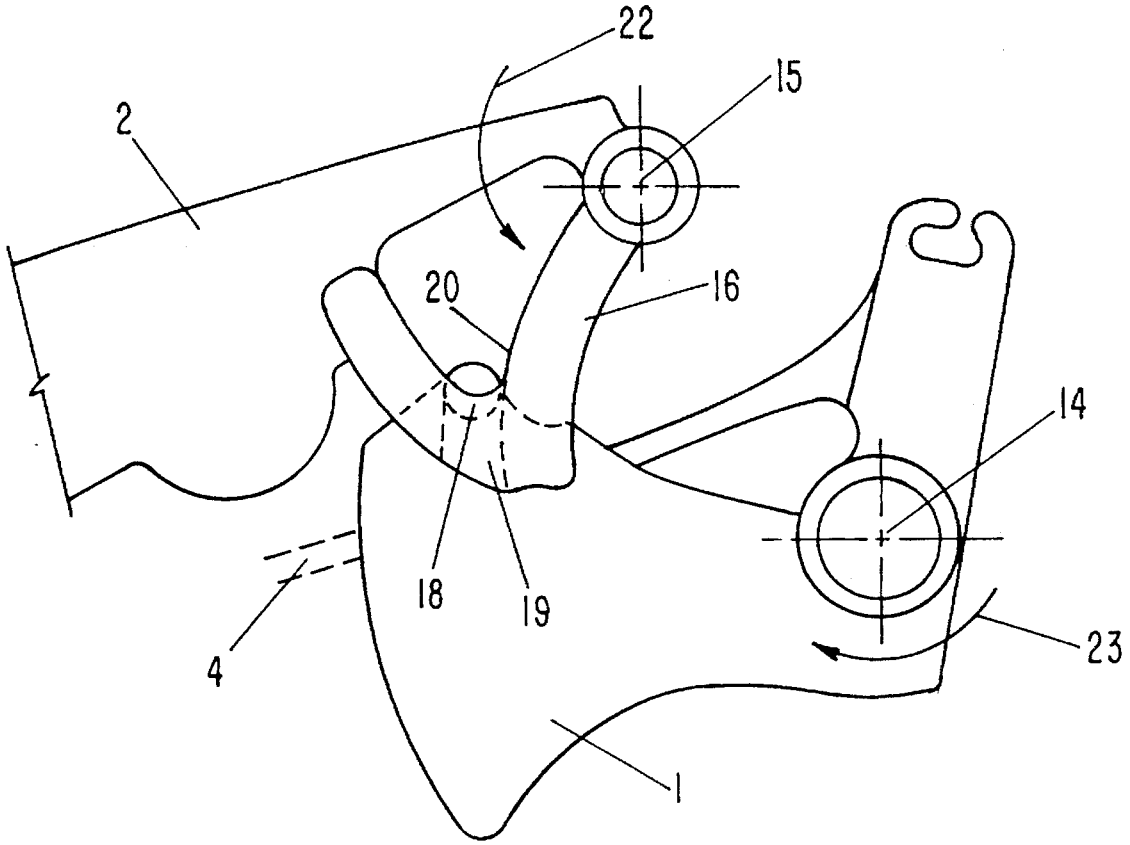
FIG. 3*a* shows the locked position of the trigger lock.

The function of the throttle trigger lock 2, which is to allow the throttle trigger 1 to be pivoted only when the throttle trigger lock 2 is pressed down, is achieved with the aid of a locking projection 16 provided at the throttle trigger lock 2. The locking projection 16 has an end face 17 with a rounded surface. In the rest position of the throttle trigger lock 2, the locking projection 16 is positioned so as to be within the pivot path of a locking pin 18 of the throttle trigger 1. Thus, when the throttle trigger lock 2 is not activated, a pivoting of the throttle trigger 1 is impossible. Only after pressing down the throttle trigger lock 2, the locking pin 18 can engage preferably a receiving slot 19 provided at the locking projection 16 (see FIG. 3*a*). During the pivoting movement of the throttle trigger 1 the pin 18 advantageously glides along the inner side 20 of the locking projection 16 which inner side 20 is facing the receiving slot 19. The inner side 20 is advantageously curved so that the locking pin 18 resting at the inner side 20 maintains the throttle trigger lock 2 in the suppressed position so that the operator must not exert a force onto the throttle trigger lock 2. Accordingly, the return force exerted by the spring section 5 onto the throttle trigger lock 2 is compensated by the locking pin 18 and introduced into the throttle trigger 1. The palm of the operator's hand, which grips the handle 13, is completely relieved from the pressure of the throttle trigger lock 2. This allows for a long term operation of the device by the operator.

The component 12 is advantageously made by injection molding of a low-density material which provides additional elastic properties, for example, polyacetal. During the manufacturing process the material is injected into a prefabricated mold at a designated injection point 24.

In another non-represented embodiment of the invention, the pivot axes 14 and 15 may be combined to a common pivot axis so that the throttle trigger 1 and the throttle trigger lock 2 are pivotable about a common pivot axis. In this embodiment, which is constructively even more simplified, the constructive space for the component 12 can be further reduced without the function of the device as described above being affected.

The present invention is, of course, in no way restricted to the specific disclosure of the specification and drawings, but also encompasses any modifications within the scope of the appended claims.

What we claim is:

1. A throttle trigger device for an internal combustion engine of a working tool, said throttle trigger device comprising:

a throttle trigger connected to a handle of the working tool so as to be pivotable about a pivot axis;

a throttle trigger lock connected to the handle of the working tool so as to be pivotable about a pivot axis;

a spring connected between said throttle trigger and said throttle trigger lock;

said throttle trigger, said throttle trigger lock, and said spring forming a unitary part; and wherein said spring rests at an abutment of the handle at least when under load such that said spring is divided into functionally independent sections, a first said section extending between said abutment and said throttle trigger and a second said section extending between said abutment and said throttle trigger lock.

2. A throttle trigger device according to claim 1, wherein said first section and said second section are positioned in two parallel planes that are spaced at a distance from one another.

3. A throttle trigger device according to claim 2, wherein said spring comprises a connecting section connecting said first section and said second section and bridging said distance between said parallel planes.

4. A throttle trigger device according to claim 3, wherein said throttle trigger is positioned in one of said parallel planes and wherein said throttle trigger lock is positioned in the other of said parallel planes.

5. A throttle trigger device according to claim 3, wherein said throttle trigger and said throttle trigger lock are positioned together in one of said parallel planes.

6. A throttle trigger device according to claim 3, wherein said connecting section is connected to ends of said first and said second sections pointing in the same direction.

7. A throttle trigger device according to claim 1, wherein said first and said second sections are in the form of leaf springs.

8. A throttle trigger device according to claim 7, wherein each one of said first and said second sections has a curvature.

9. A throttle trigger device according to claim 8, wherein said curvature has a wave shape.

10. A throttle trigger device according to claim 8, wherein said curvature of said first section is a sine wave.

11. A throttle trigger device according to claim 1, wherein said unitary part is mounted within the handle such that said spring is prestressed.

12. A throttle trigger device according to claim 1, wherein said pivot axis of said throttle trigger and said pivot axis of said throttle trigger lock extend parallel to one another.

13. A throttle trigger device according to claim 1, wherein:

said throttle trigger lock has a locking projection facing said throttle trigger;

said throttle trigger has a locking pin; and said locking projection, in a rest position of said throttle trigger lock, is positioned in a pivot path of said locking pin.

14. A throttle trigger device according to claim 13, wherein said locking projection has a receiving slot that, in an actuated position of said throttle trigger lock, is positioned facing said locking pin so that, upon pivoting said throttle trigger, said locking pin is pivoted into said receiving slot.

15. A throttle trigger device according to claim 14, wherein said locking pin rests on an inner side of said locking projection that is facing said receiving slot.

16. A throttle trigger device according to claim 15, wherein said inner side is curved so as to conform to a pivot path of said locking pin such that said locking pin resting at said inner side locks said throttle trigger lock when said throttle trigger is pivoted.

17. A throttle trigger device according to claim 1, wherein said unitary part is injection-molded from plastic.

18. A throttle trigger device according to claim 17, wherein said plastic is polyacetal.

* * * * *